US006500043B1

(12) United States Patent
Fong

(10) Patent No.: US 6,500,043 B1
(45) Date of Patent: Dec. 31, 2002

(54) ANIMATED TOY

(76) Inventor: Peter Sui Lun Fong, 297F S. Atlantic Blvd., Monterey Park, CA (US) 91754

( * ) Notice: Subject to any disclaimer, the term of this patent is extended or adjusted under 35 U.S.C. 154(b) by 0 days.

(21) Appl. No.: 09/456,973

(22) Filed: Dec. 7, 1999

(51) Int. Cl.[7] ..... A63H 11/00; A63H 13/00; A63H 3/20

(52) U.S. Cl. ..... 446/330; 446/353; 446/354; 40/418; 40/414

(58) Field of Search ..... 446/330, 353, 446/354, 358

(56) References Cited

U.S. PATENT DOCUMENTS

| | | | | | |
|---|---|---|---|---|---|
| 674,970 | A | | 5/1901 | Kennedy | |
| 711,510 | A | | 10/1902 | Little | |
| 1,415,344 | A | | 5/1922 | Haskell | |
| 1,423,383 | A | | 7/1922 | Zaiden | |
| 1,674,943 | A | | 6/1928 | Berger | |
| 1,685,358 | A | | 9/1928 | Harcourt | |
| 2,637,936 | A | | 5/1953 | Dale et al. | 46/120 |
| 2,691,845 | A | | 10/1954 | Jepson | 46/120 |
| 3,613,299 | A | | 10/1971 | Amici et al. | 46/120 |
| 3,643,374 | A | | 2/1972 | Gunther et al. | 46/139 |
| 3,660,931 | A | | 5/1972 | Gardel et al. | 46/120 |
| 3,888,023 | A | | 6/1975 | Genin | 35/29 |
| 4,040,206 | A | | 8/1977 | Kimura | 46/138 |
| 4,545,775 | A | | 10/1985 | Kim | 446/299 |
| 4,676,764 | A | | 6/1987 | Yeu | 446/298 |
| 4,801,285 | A | | 1/1989 | Yeu | 446/298 |
| 4,802,878 | A | * | 2/1989 | Terzian et al. | |
| 4,828,530 | A | | 5/1989 | Lee | 446/354 |
| 4,836,819 | A | | 6/1989 | Oishi et al. | 446/288 |
| 4,846,752 | A | | 7/1989 | Combs | 446/279 |
| 4,867,730 | A | | 9/1989 | Lee | 446/353 |
| 4,869,703 | A | | 9/1989 | Ong | 446/353 |
| 4,878,878 | A | | 11/1989 | Bittner | 446/139 |
| 4,901,459 | A | | 2/1990 | Lee | 40/414 |
| 4,944,708 | A | | 7/1990 | Kawabe | 446/175 |
| 5,147,238 | A | | 9/1992 | Kelley et al. | 446/330 |
| 5,176,560 | A | | 1/1993 | Wetherell et al. | 466/175 |
| 5,224,896 | A | | 7/1993 | Terzian | 446/355 |
| 5,324,224 | A | * | 6/1994 | Anderson et al. | 446/91 |
| 5,609,340 | A | | 3/1997 | Chuang | 273/448 |
| 5,695,382 | A | * | 12/1997 | Lin | 446/354 |
| 5,735,726 | A | | 4/1998 | Cohen | 446/298 |
| 5,859,509 | A | * | 1/1999 | Bienz et al. | |
| 5,911,617 | A | | 6/1999 | Chou | 446/353 |
| 5,941,756 | A | * | 8/1999 | Chou | 446/330 |
| 6,071,170 | A | * | 6/2000 | How | 446/330 |
| 6,126,508 | A | * | 10/2000 | Chou | 446/358 |
| 6,200,191 | B1 | * | 3/2001 | Chou | 446/353 |
| 6,200,192 | B1 | * | 3/2001 | Hou | 446/358 |
| 6,244,925 | B1 | * | 6/2001 | Chou | 446/354 |

FOREIGN PATENT DOCUMENTS

| | | | |
|---|---|---|---|
| GB | 2221401 | 7/1990 | A63H/13/00 |

* cited by examiner

*Primary Examiner*—Derris H. Banks
*Assistant Examiner*—Ali Abdelwahed
(74) *Attorney, Agent, or Firm*—Stetina Brunda Garred & Brucker

(57) ABSTRACT

An animated toy comprising a toy body which itself includes at least one shoulder member and a pair of waist members, the upper ends of which are pivotally connected to the shoulder member. The toy body further includes a pair of leg members having upper ends which are pivotally connected to the lower ends of respective ones of the leg members. The lower ends of the leg members are pivotally connected to respective ones of a pair of foot members. Rotatably connected to a shoulder member is a pair of arm members of the toy body which is mechanically coupled to the upper ends of respective ones of the waist members so as to be alternately moveable in different directions thereby. In addition to the toy body, the animated toy comprises a drive unit mounted to the toy body and including a reversible motor which is mechanically coupled to the leg members and operative to reciprocally tilt the leg members in first and second directions.

27 Claims, 8 Drawing Sheets

46
38
104
14
16
22
42
40
126
38
42
40
22
86
126
64
20
62
12
124
76
20
88
96
124
90
94
78
78
32
32
70
80
80
24
24
82
82
102
100
98
58
30
30
34
35
34
35
36
36

ANIMATED TOY

CROSS-REFERENCE TO RELATED APPLICATIONS (Not Applicable)

STATEMENT RE: FEDERALLY SPONSORED-RESEARCH/DEVELOPMENT (Not Applicable)

BACKGROUND OF THE INVENTION

The present invention relates generally to motion toys, and more particularly to an animated toy comprising a plurality of structural elements pivotally connected to each other in a manner defining a human body, and a reversible motor which is cooperatively engaged to the structural elements and operative to cause portions of the body defined thereby to alternatively tilt or sway in different directions.

There is currently known in the prior art a wide variety of animated or motion toys which employ the use of one or more motors and associated transmission gear trains to facilitate the movement of various parts of the toy. These animated toys include figurines which have the shape of a human body, with the motor(s) and gear train(s) thereof being operative to cause various parts of the body, such as the arms, legs and/or head, to move separately and/or in unison.

One such animated or motion toy currently known in the prior art is disclosed in U.S. Pat. No. 5,911,617 issued on Jun. 15, 1999 to Chou. The motion toy disclosed in the Chou patent differs from those known in the prior art by, among other things, the capability of the upper and lower parts of the body thereof to alternatively tilt inwardly and outwardly in reverse directions. To achieve this particular range of motion, the motion toy disclosed in the Chou patent comprises a pair of waist cover shells, the upper ends of which are pivotally connected to respective ones of a pair of shoulder cover shells, with the lower ends of the waist cover shells being pivotally connected to respective ones of a pair of foot cover shells. Also included in the motion toy is a pair of trunk cover shells which are connected to respective ones of the shoulder cover shells and a motor mount which is mounted within a cavity collectively defined by the waist, shoulder and trunk cover shells. A reversible motor is attached to the motor mount and mechanically coupled to the foot cover shells via a pair of main racks which are integrally formed on respective ones of the foot cover shells.

Though the body of the motion toy disclosed in the Chou patent is uniquely configured in a manner wherein the upper and lower parts thereof alternatively tilt inwardly and outwardly in reverse directions, such motion toy possesses certain deficiencies which detract from its overall utility. These deficiencies include the inability of the upper and lower parts of the body to tilt or sway at differing speeds. In this respect, the reversible motor of the animated toy disclosed in the Chou patent operates at only a single speed or frequency, thus resulting in the speed or rate at which the upper and lower parts of the body tilt inwardly and outwardly being a constant during the operation of the motion toy. Additionally, the motion toy disclosed in the Chou patent is devoid of any structures which provide for the movement of the arms and head of the toy which are attached to the shoulder cover shells thereof. As will be recognized, such movement of the arms and/or head would provide a more life-like, appealing appearance during the operation of the motion toy. Moreover, the structures employed to facilitate the mechanical coupling of the reversible motor to the foot cover shells, and more particularly to the main racks thereof, creates an imbalance during operation which gives rise to a susceptibility for the motion toy to fall over onto one of its sides upon reaching the limits or extremes of its inward and outward movements. Indeed, in the commercially marketed embodiment of the motion toy disclosed in the Chou patent, the foot plates which are pivotally connected to the lower ends of respective ones of the foot cover shells are themselves attached to a common base plate for purposes of providing support to the motion toy and preventing the same from falling over due to the above-described imbalance condition.

The present invention provides an animated or motion toy similar in structure and operation to that disclosed in the Chou patent, but eliminating the above-described deficiencies. More particularly, the animated toy of the present invention is provided with an internal cam arrangement which facilitates the alternating upward and downward movement of the arms attached to the shoulder member of the body thereof. This cam arrangement also provides for the rotation of the head attached to the shoulder member in a back and forth motion. Additionally, unique electronic circuitry is provided in the animated toy of the present invention which is in electrical communication with the reversible motor thereof. This electronic circuitry is capable of operating the reversible motor at differing speeds, thus allowing for variations in the speed or rate of the swaying motion of the upper and lower portions of the body which are in time with the music played by the animated toy during its operation. Moreover, the animated toy of the present invention is provided with discrete rack members which are used to mechanically couple the reversible motor to the leg members in a manner maintaining the balance and stability of the present animated toy through its complete range of tilting movement, thus eliminating the need for additional support structures such as a base plate attached to the foot members thereof. These and other unique attributes of the present invention will be discussed in more detail below.

BRIEF SUMMARY OF THE INVENTION

In accordance with the present invention, there is provided an animated toy which comprises a toy body. The toy body itself comprises a shoulder member and a pair of waist members, the upper ends of which are pivotally connected to the shoulder member. The toy body further comprises a pair of leg members, the upper ends of which are pivotally connected to the lower ends of respective ones of the waist members, and a pair of foot members which are pivotally connected the lower ends of respective ones of the leg members. In addition to the shoulder, waist, leg and foot members, the toy body includes a pair of arm members and a head member which are each rotatably connected to the shoulder member.

In addition to the toy body, the animated toy of the present invention comprises a drive unit which is mounted to the toy body and includes a reversible motor which is mechanically coupled to the leg members and operative to reciprocally tilt the leg members in first and second directions. The tilting of the leg members in the first and second directions occurs in unison. The drive unit preferably comprises a motor mount which is pivotally connected to the shoulder member and extends between the waist members. The reversible motor is itself preferably attached to the motor mount, with the tilting of the leg members in the first direction causing the motor mount to be tilted in the second direction, and the tilting of the leg members in the second direction causing the motor mount to be titled in the first direction.

In the present animated toy, the arm members of the toy body are mechanically coupled to the upper ends of respective ones of the waist members so as to be alternately movable in different directions thereby. More particularly, the mechanical coupling of the arm members to the waist members is accomplished such that the tilting of the waist members in the first and second directions causes the arm members to alternately move in different (i.e., opposite) directions. Similarly, the head member of the toy body is mechanically coupled to the motor mount such that the tilting of the motor mount in the first and second directions causes the head member to alternately rotate in different directions. The toy body may further include front and back trunk plates which are each attached to the motor mount and, together with the waist members and shoulder member, collectively define an interior cavity which accommodates the motor mount and hence the reversible motor.

To facilitate the alternating movement of the arm members, each of the waist members preferably includes a cam portion which defines the upper end thereof and has a slot formed therein Additionally, each of the arm members preferably includes an arm pin which protrudes therefrom and is received into the slot of a respective one of the cam portions. The tilting of the waist members in the first and second directions causes the cam portions to act against the arm pins in a manner facilitating the alternate rotation of the arm members in opposite directions.

To facilitate the alternate rotation of the head member, the motor mount preferably includes a pair of cam levers which protrude therefrom in spaced, generally parallel relation to each other. The head member itself defines a central axis and includes a head pin protruding therefrom in radially off-set relation to the central axis. When the head member is rotatably connected to the shoulder member, the head pin is extended between the cam levers such that the tilting of the motor mount in the first and second directions causes the cam levers to act against the head pin in a manner facilitating the alternate rotation of the head member in opposite directions.

The animated toy of the present invention may further comprise a variable speed control unit which is disposed within the toy body and in electrical communication with the reversible motor. The control unit is operative to selectively increase and decrease the speed of the reversible motor, and hence the rate at which the waist members are tilted in the first and second directions thereby. Also included in the animated toy of the present invention is a speaker which is mounted to the toy body, and a music unit which is disposed within the toy body and in electrical communication with the speaker and the control unit. The music unit is operative to produce music signals, with the control unit being operative to increase and decrease the speed of the reversible motor in time with the music signals produced by the music unit and transmitted to the speaker. Both the music unit and the control unit are preferably disposed within one of the foot members of the toy body.

The animated toy of the present invention may further comprise a pair of rack members which are rotatably connected to respective ones of the leg members, and each include a rack portion and a spring portion. The spring portion of each of the rack members is cooperatively engagable to a respective one of the leg members, with the tilting of the leg members in the first and second directions being limited by the alternate engagement of the spring portions of the rack members to respective ones of the leg members. Such engagement of the spring portions to the leg members occurs when the leg members reach the extreme limits of their tilting movement in the first and second directions, and prevents excess tilting as could result in the animated toy falling onto one of its sides. The dampening effect facilitated by the spring portions of the rack members may be complemented by a pair of dampening members which are attached to the motor mount and alternately engagable to the waist members during the tilting thereof in the first and second directions.

In accordance with an alternative embodiment of the present invention, the waist members of the toy body are pivotally connected to only the motor mount, and thus have no physical contact with the shoulder member. In this alternative embodiment, the motor mount is itself formed to include the cam portions, with such cam portions being mechanically coupled to respective ones of the arm members. As such, the back and forth tilting of the motor mount in the first and second directions results in the cam portions thereof acting against the arm pins of the arm members in a manner facilitating the alternate rotation of the arm members in opposite directions.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
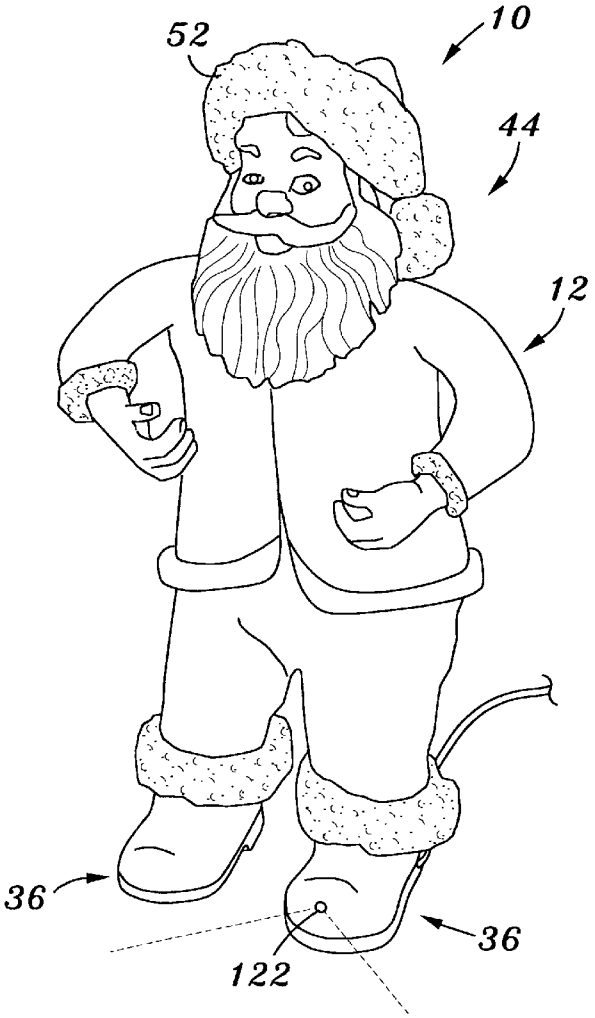
FIG. 1 is a front prospective view of the animated toy of the present invention.

Referring now to the drawings when the showings are for purposes of illustrating a preferred embodiment of the present invention only, and not for purposes of limiting the same, FIG. 1 perspectively illustrates the animated toy 10 constructed in accordance with the present invention. As seen in FIG. 1, the animated toy 10 has the configuration of a human being, and more particularly Santa Claus. As will be discussed in more detail below, the animated toy 10 includes a head, torso, arms, legs and feet. Though being provided in the form of a human body, those of ordinary skill in the art will recognize that the animated toy 10 need not necessarily resemble Santa Claus.

Figure 5:
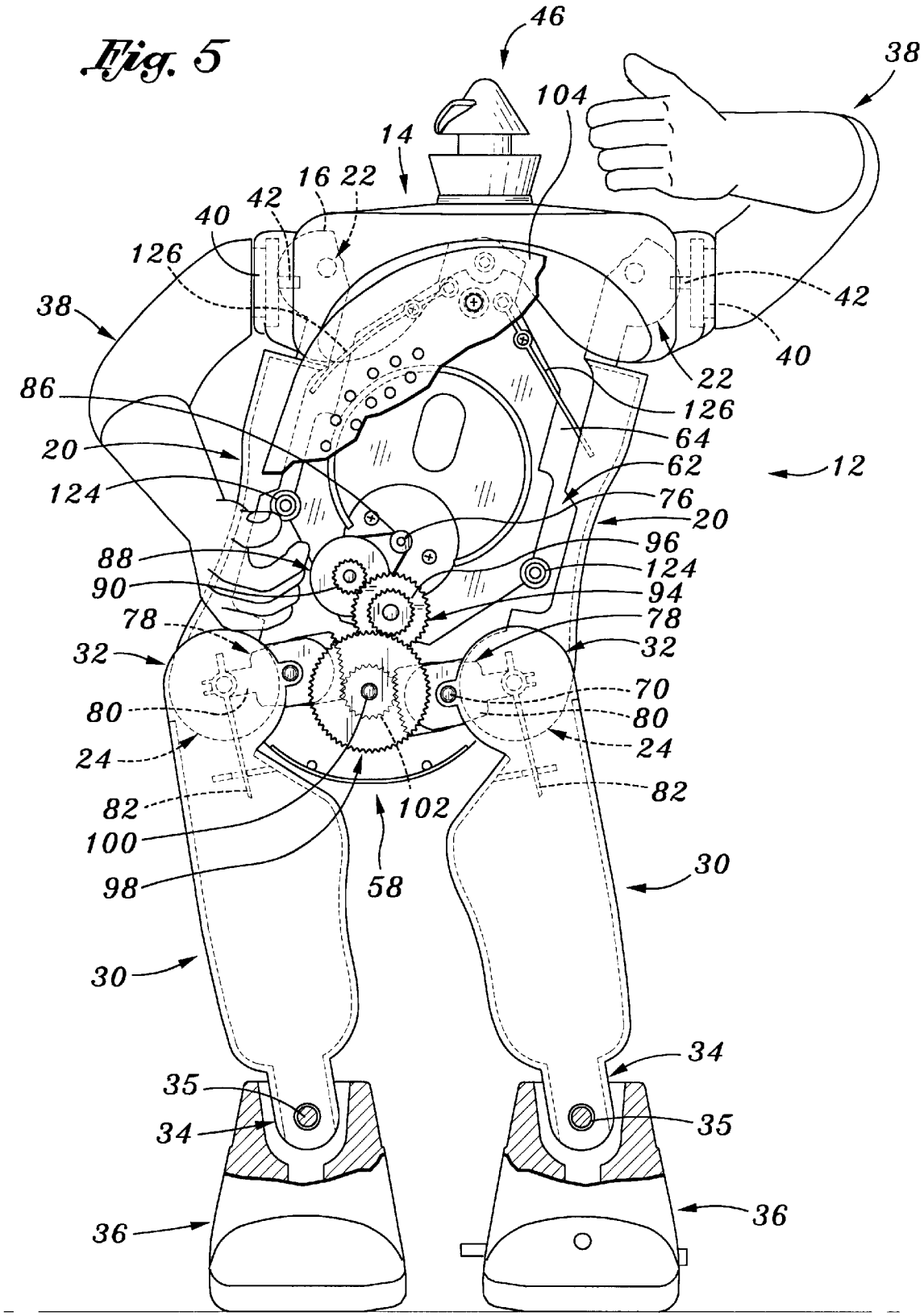
FIG. 5 is a front elevational, partial cross-sectional view of the present animated toy at one limit of its range of motion.
Figure 6:
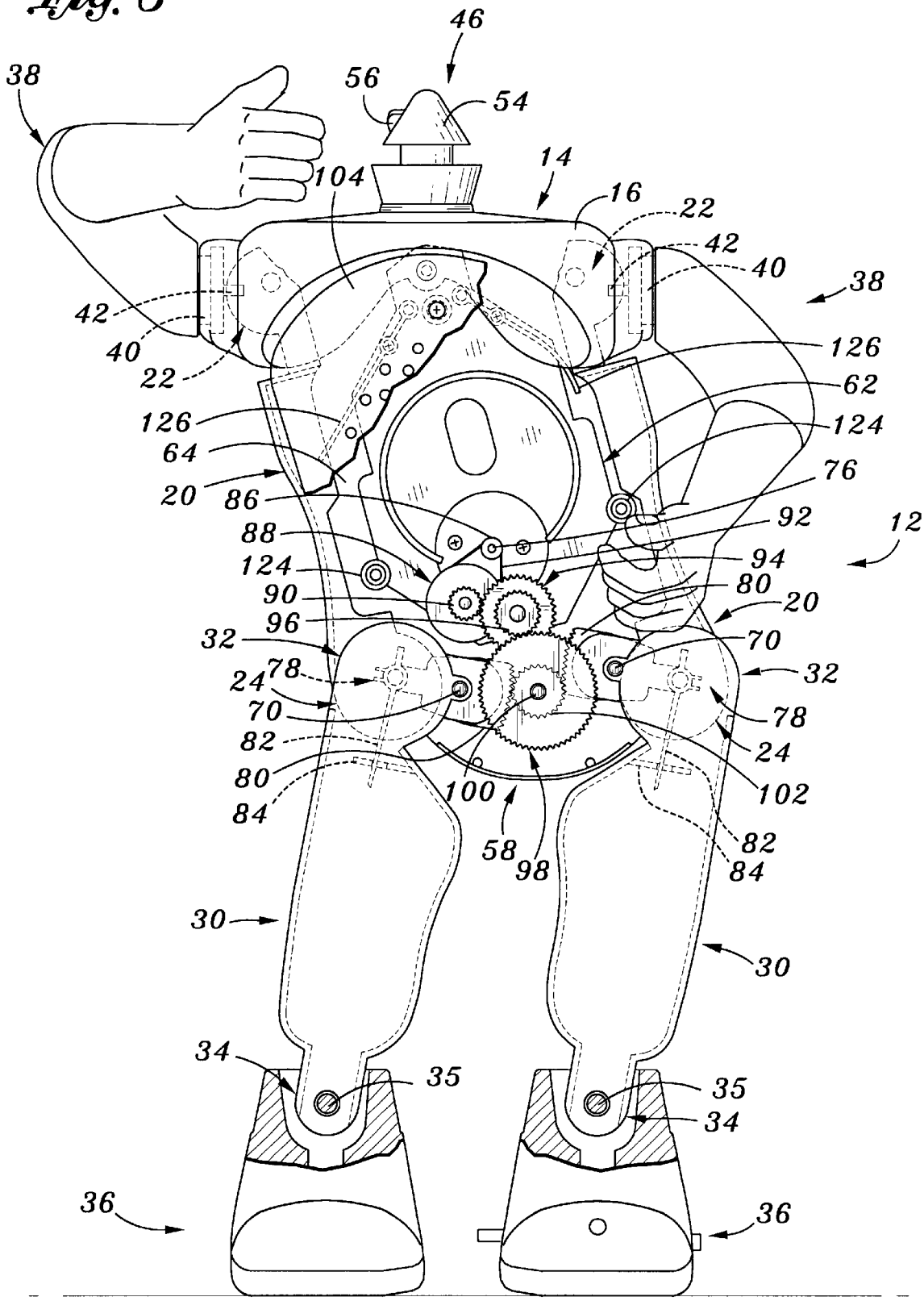
FIG. 6 is a front elevational, partial cross-sectional view of the present animated toy similar to that shown in FIG. 5, but illustrating the opposite limit of its range of motion.
Figure 7:
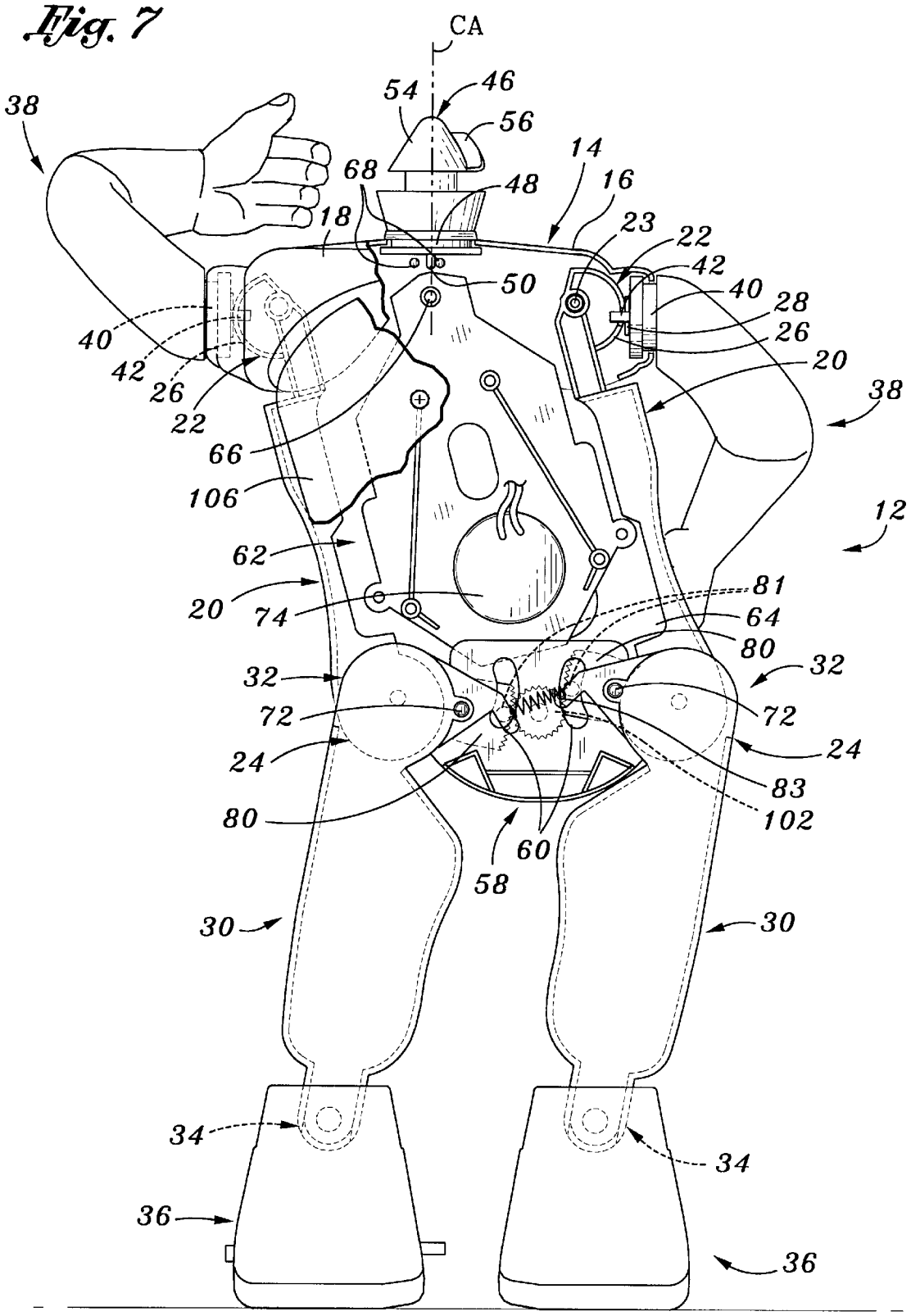
FIG. 7 is a back elevational, partial cross-sectional view of the present animated toy at the limit of its range of motion shown in FIG. 5.
Figure 8:
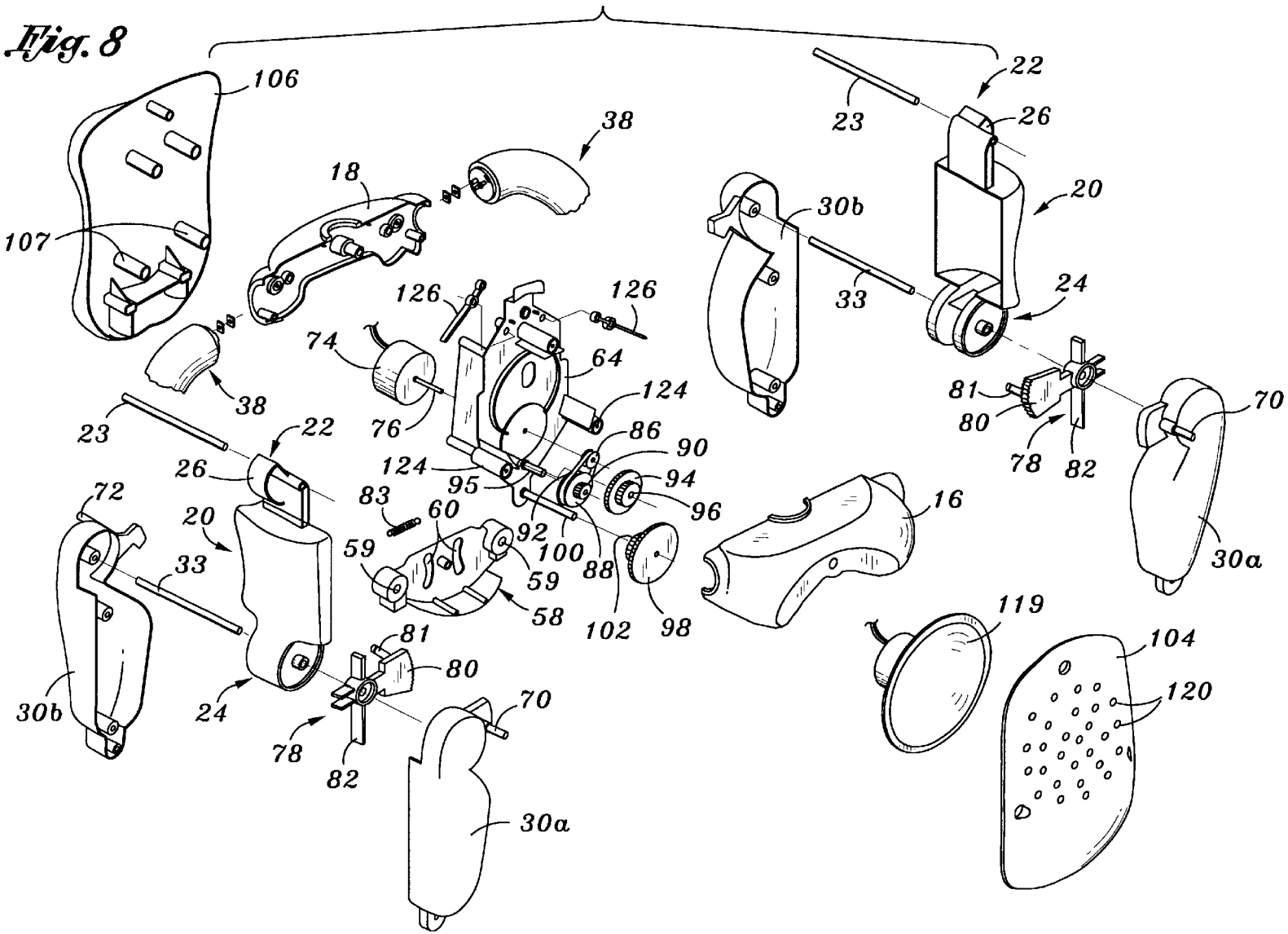
FIG. 8 is an exploded view of the present animated toy, illustrating the various components thereof.

Referring now to FIGS. 2 and 5–8, the animated toy 10 comprises a toy body 12 which itself comprises a shoulder member 14. In the preferred embodiment, the shoulder member 14 includes a front shoulder section 16 and a back shoulder section 18 which are rigidly attached to each other via fasteners such as screws. In addition to the shoulder member 14, the toy body 12 includes a pair of waist members 20, each of which defines an upper end 22 and a lower end 24. The upper ends 22 of the waist members 20 are pivotally connected to the shoulder member 14 via fasteners 23 such as a pair of pivot pins. The upper ends 22 of the waist members 20 are inserted between the front and back shoulder sections 16, 18, and more particularly into a cavity collectively defined thereby. Each fastener 23 is advanced through a respective upper end 22, with the opposed ends of such fastener 23 being received into a corresponding pair of tubular bosses formed on respective ones of the front and back shoulder sections 16, 18. As best seen in FIG. 7, in the preferred embodiment, the upper end 22 of each waist member 20 is defined by an arcuate cam portion 26 which includes a slot 28 formed therein. The use of the cam portion 26 and slot 28 of each waist member 20 will be discussed in more detail below.

Figure 2:
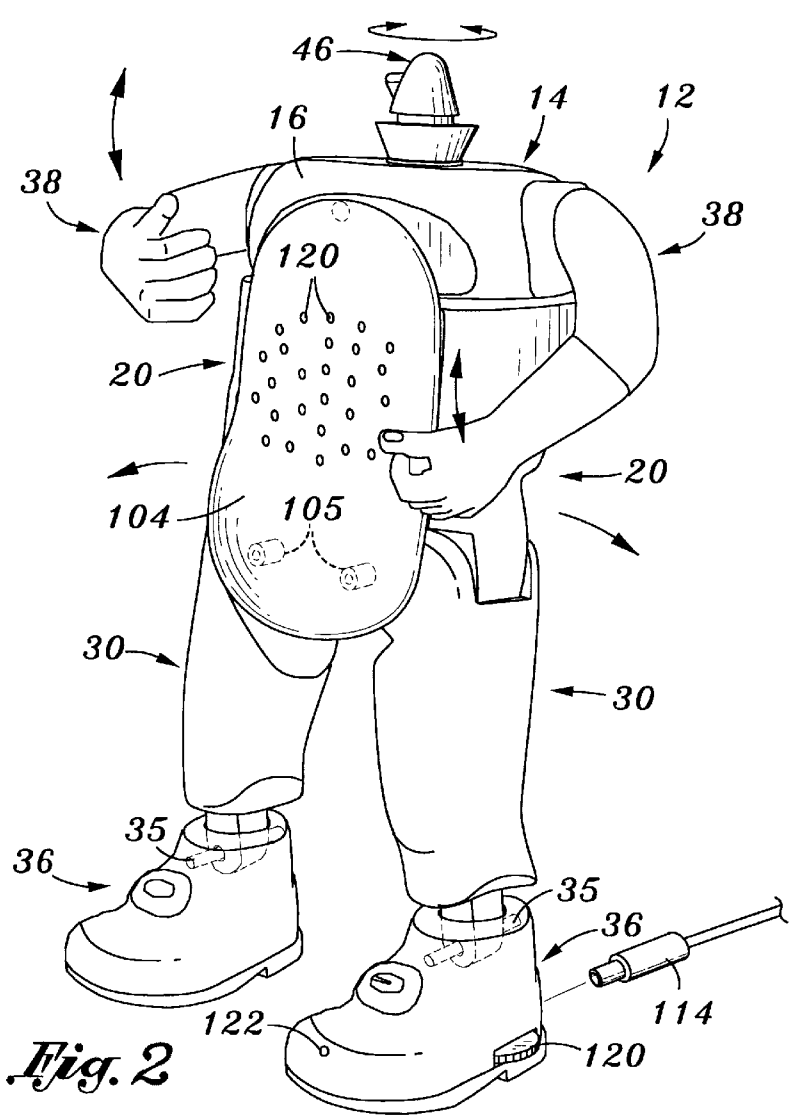
FIG. 2 is a partial front prospective view of the present animated toy illustrating the movement capability of various portions thereof.

The toy body 12 of the animated toy 10 further comprises a pair of leg members 30, each of which defines an upper end 32 and a lower end 34. Though not shown, the leg members 30 are preferably not unitary structures, but rather each comprise front and back leg sections 30*a*, 30*b* which are rigidly attached to each other via fasteners such as screws. In the animated toy 10, the upper ends 32 of the leg members 30 are pivotally connected to the lower ends 24 of respective ones of the waist members 20 via a pair of fasteners such as pivot pins 33. More particularly, as best seen in FIG. 2, the lower end 24 of each waist member 20 is inserted between a pair of ear portions defined at the upper end 32 of a respective leg member 30. One of these ear portions is formed on the front leg section 30*a* of the leg member 30, with the other ear portion being formed on the rear leg section 30*b* thereof. A pivot pin 33 is advanced through the lower end 24, with the opposed ends of the pivot pin 33 being received into and supported by a pair of tubular bosses formed on respective ones of the ear portions defining the corresponding upper end 32. The toy body 12 further comprises a pair of foot members 36 which are themselves pivotally connected to the lower ends 34 of respective ones of the leg members 30 via fasteners 35 such as pivot pins.

As best seen in FIGS. 5–7, protruding forwardly from the upper ends 32 of respective ones of the leg members 30 is a front pair of leg pins 70. Similarly, protruding rearwardly from the upper ends 32 of respective ones of the leg members 30 is a back pair of leg pins 72. More particularly, the leg pins 70 of the front pair protrude forwardly from the front leg sections 30*a* of respective ones of the leg members 30, with the leg pins 72 of the back pair protruding rearwardly from the back leg sections 30*b* of respective ones of the leg members 30. The use of the leg pins 70, 72 of the front and back pairs will be discussed in more detail below.

The toy body 12 of the animated toy 10 further comprises a pair of arm members 38 which are rotatably connected to respective ones of the opposed ends of the shoulder member 14 in the manner best shown in FIGS. 5–7. More particularly, each of the arm members 38 defines a continuous groove or channel 40 which extends thereabout in close proximity to the end thereof opposite the end formed to include the fingers. The channel 40 of each arm member 38 is sized and configured to receive a complimentary, continuous annular lip collectively defined by the front and back shoulder sections 16, 18 of the shoulder member 14, with the receipt of such lip into the channel 40 facilitating the rotatable attachment of the arm member 38 to the shoulder member 14. As will be recognized, to facilitate the receipt of each of the annular lips of the shoulder member 14 into a respective channel 40, the arm members 38 are positioned between the front and back shoulder sections 16, 18 in a prescribed manner prior to the rigid attachment thereof to each other.

As further seen in FIGS. 5–7, each of the arm members 38 includes an arm pin 42 protruding axially from the end thereof disposed closest to the channel 40. When the arm members 38 are rotatably connected to the shoulder member 14 in the above-described manner, the arm pins 42 thereof are inserted into the slots 28 of respective ones of the cam portions 26 of the waist members 20. The receipt of the arm pins 42 into the slots 28 allows the cam portions 26 to act against the arm pins 42 in a manner which facilitates the alternating upward and downward movement of the arm members 38 as will be discussed in more detail below.

Also rotatably connected to the shoulder member 14 is a head member 44 of the toy body 12. The head member 44 includes a stem section 46 which is itself rotatably connected to the shoulder member 14. More particularly, as best seen in FIG. 7, the stem section 46 defines a continuous groove or channel 48 which extends thereabout and is sized and configured to receive a complimentary annular edge collectively defined by the front and back shoulder sections 16, 18. This annular edge defines the periphery of a circular opening formed within the top of the shoulder member 14. The stem section 46 defines a central axis CA and, when rotatably connected to the shoulder member 14, is adapted to rotate about the central axis CA. Protruding from that end of the stem section 46 disposed closest to channel 48 is a head pin 50. In the toy body 12, the head pin 50 is not coaxially aligned with the central axis CA, but rather extends from the end of the stem section 46 in radially off-set relation to the central axis CA for reasons which will be described in more detail below. As such, the head pin 50, like the arm pins 42, resides within the interior of the shoulder member 14.

In addition to the stem section 46, the head member 44 includes a decorative outer section 52 which is attached to a generally conical end portion 54 of the stem section 46 located opposite the end including the head pin 50 protruding therefrom. Extending laterally from the end portion 54 is a locking tab 56 of the stem section 46. The attachment of the outer section 52 to the stem section 46 is facilitated by the insertion of the end portion 54 and locking tab 56 into a complimentary opening and associated slot formed within the outer section 52. The receipt of the locking tab 56 into its corresponding slot within the outer section 52 prevents the rotation of the outer section 52 relative to the stem section 46, thus ensuring that the outer section 52 rotates concurrently with the stem section 46. The head pin 50 protruding from the stem section 46 facilitates the rotation of the head member 44 in a manner 20 which will described in more detail below.

The toy body 12 of the animated toy 10 further comprises a lower support strut 58 having opposed ends which are pivotally connected to those pivot pins 33 used to facilitate the pivotal connection of the upper ends 32 of the leg members 30 to lower ends 24 of respective ones of the waist members 20. As such, the support strut 58 extends between the lower ends 24 of the waist members 20, as well as the upper ends 32 of the leg members 30. The pivot pins 33 used to pivotally connect the waist members 20 to the leg members 30 are advanced through a corresponding pair of apertures 59 disposed within respective ones of the opposed ends of the support strut 58. Also formed within the support strut 58 is a spaced pair of arcuate slots 60, the use of which will be discussed in more detail below.

In addition to the toy body 12, the animated toy of the present invention comprises a drive unit 62 which is mounted to the toy body 12 and operative to reciprocally tilt the leg members 30 in first and second directions in a manner which will be described in more detail below. The drive unit 62 itself preferably comprises a motor mount 64 having an upper end which is pivotally connected to the shoulder member 14 via a fastener 66 such as a pivot pin. Protruding from a common side of the upper end of the motor mount 64 in spaced, generally parallel relation to each other is a pair of cam levers 68. As best seen in FIG. 7, when the stem section 46 of the head member 44 is rotatably connected to the shoulder member 14, the head pin 50 is advanced between the cam lever 68 of the motor mount 64. As will also be discussed in more detail below, the cam levers 68 act against the head pin 50 in a manner which facilitates the alternate rotation of the head member 44.

As best seen in FIGS. 5–7, the drive unit 62 of the animated toy 10 further comprises a reversible motor 74 which is attached to the back side or surface of the motor mount 64. Extending from the reversible motor 74 is a drive shaft 76 which is advanced through the motor mount 64 and protrudes from the front side or surface thereof. As will be recognized, the reversible motor 74 is operative to selectively rotate the drive shaft 76 in either clockwise or counter-clockwise directions. As will be discussed in more detail below, this alternating clockwise and counter-clockwise rotation of the drive shaft 76 facilitates the tilting or swaying motion of the leg members 30 of the toy body 12.

In the animated toy 10 of the present invention, the reversible motor 74, and in particular the drive shaft 76 thereof, is mechanically coupled to the leg members 30 such that the rotation of the drive shaft 76 in clockwise and counter-clockwise directions facilitates the tilting or swaying of the leg members 30 in first and second directions (i.e., back and forth) in unison. To facilitate such mechanical coupling, the animated toy 10 of the present invention is provided with an identically configured pair of rack members 78 which are rotatably connected to respective ones of those pivot pins 33 used to facilitate the pivotal connection of the upper ends 32 of the leg members 30 to lower ends 24 of respective ones of the waist members 20. Each of the rack members 78 includes a rack portion 80 and an elongate, flexible/resilient spring portion 82. The rack members 78 are rotatably connected to their respective pivot pins 33 such that the rack portions 80 thereof are directed inwardly toward each other, with the spring portions 82 extending downwardly into the hollow interior of respective ones of the leg members 30. Formed on the distal end of each rack portion 80 is a gear rack, the use of which will be discussed in more detail below.

As best seen in FIG. 7, in addition to the rack and spring portions 80, 82, each of the rack members 78 further includes an elongate stem portion 81. When the rack members 78 are pivotally connected to the pivot pins used to facilitate the pivotal connection of the leg members 30 to the waist members 20, the stem portions 81 are extended or advanced through respective ones of the slots 60 of the support strut 58. The distal ends of the stem portions 81 are interconnected by a helical spring 83.

As best seen in FIGS. 5 and 6, each of the leg members 30 is formed to include an integral drive tab portion 84 within the hollow interior thereof. Formed within each drive tab portion 84 is a slot which is adapted to receive the spring portion 82 of a respective rack member 78. The locations of the drive tab portions 84 within the leg members 30 and the length of the spring portions 82 is such that when the rack members 78 are pivotally connected to respective ones of the pivot pins used to pivotally connect the leg members 30 to the waist members 20, the spring portions 82 of the rack members 78 are advanced through the slots of respective ones of the drive tab portions 84 in the manner shown in FIGS. 5 and 6. The advancement of the spring portions 82 through the slots of the drive tab portions 84 allows the rack members 78 to act against the leg members 30 in a manner facilitating the reciprocal tilting thereof in the first and second directions as will be discussed in more detail below.

In the animated toy 10, the reversible motor 74 is cooperatively engaged (i.e., mechanically coupled) to the rack members 78 via a transmission gear train of the drive unit 62. This transmission gear train preferably comprises a first drive member 86 which is attached to the distal end of the drive shaft 76 protruding from the front side or surface of the motor mount 64. In addition to the first drive member 86, the transmission gear train includes a second drive member 88 which is rotatably connected to the motor mount 64 via a pin. The second drive member 88 includes an integral first gear portion 90 of reduced diameter. The first drive member 86 is mechanically coupled to the second drive member 88 via a continuous transmission belt 92. In this respect, formed with the peripheral edge of both the first and second drive members 86, 88 is a continuous channel which accommodates the transmission belt 92.

The transmission gear train further comprises a first gear member 94 which is also rotatably connected to the motor mount 64 via a pin 95. The teeth formed on the peripheral edge of the first gear member 94 are cooperatively engaged to the teeth formed on the peripheral edge of the first gear portion 90 of the second drive member 88. The first gear member 94 is also formed to include an integral second gear portion 96 of reduced diameter. The transmission gear train also includes a second gear member 98 which is rotatably connected to the motor mount 64 via a pin 100. The teeth formed on the peripheral edge of the second gear member 98 are cooperatively engaged to the teeth formed on the peripheral edge of the second gear portion 96 of the first gear member 94. The second gear member 98 is itself formed to include an integral third gear portion 102 of reduced diameter. When the second gear member 98 is rotatably connected to the motor mount 96, the third gear portion 102 is extended between the rack portions 80 of the rack members 78, with the gear teeth formed on the peripheral edge of the third gear portion 102 being cooperatively engaged to the gear racks formed on the rack portions 80 of the rack members 78.

The toy body 12 of the animated toy 10 of the present invention further preferably comprises a front trunk plate 104 and a back trunk plate 106, each of which is attached to the motor mount 64 via fasteners such as screws. Importantly, the front trunk plate 104 is formed to include a plurality of tubular bosses 105 which protrude from the inner surface thereof. When the front trunk plate 104 is attached to the motor mount 64, two of these tubular bosses 105 receive respective ones of the leg pins 70 of the front pair. Another one of these tubular bosses receives the end of the pin 100 which protrudes from the second gear member 98 and is opposite that end received into the motor mount 64.

The back trunk plate 106 is itself formed to include a pair of tubular bosses 107 which protrude from the inner surface thereof and, when the back trunk plate 106 is attached to the motor mount 64, receive respective ones of the leg pins 72 of the rear pair.

Figure 3:
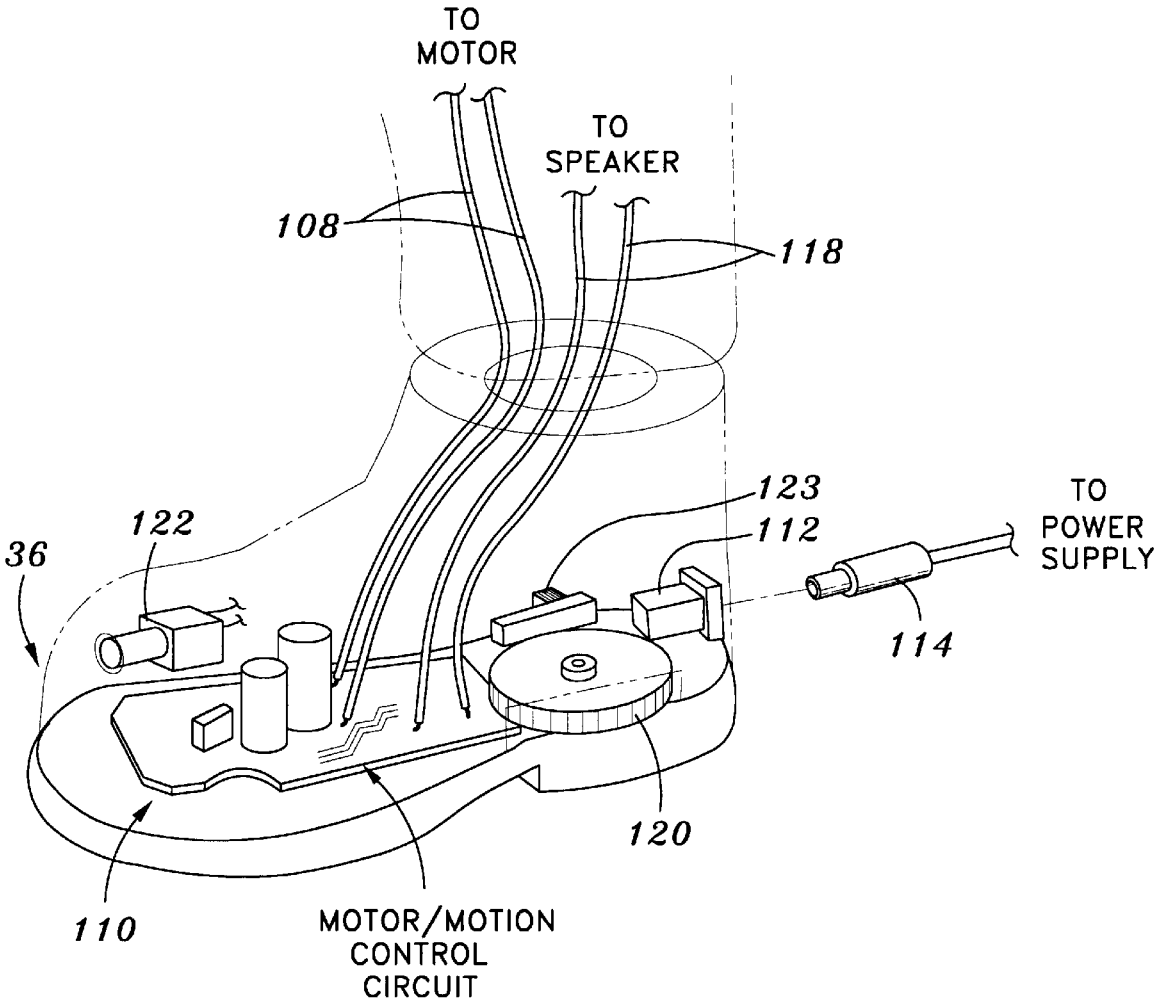
FIG. 3 is a prospective view of the motor speed control unit of the animated toy shown in FIGS. 1 and 2.

Referring now to FIGS. 1–3, the reversible motor 74 of the drive unit 72 is electrically connected via wires 108 to electronic circuitry 110 of the animated toy 100. The electronic circuitry 110 is preferably disposed within one of the hollow foot members 36 of the toy body 12. The electronic circuitry 110 includes a receptacle 112 which allows the electronic circuitry 110 to be placed into electrical communication with an external power supply through the use of an adapter 114 sized and configured to be releasably engagable to the receptacle 112. As will be recognized, the coupling of the adapter 114 to the receptacle 112 allows power from the external power supply to be communicated to the reversible motor 74 via the electronic circuitry 110.

Figure 4:
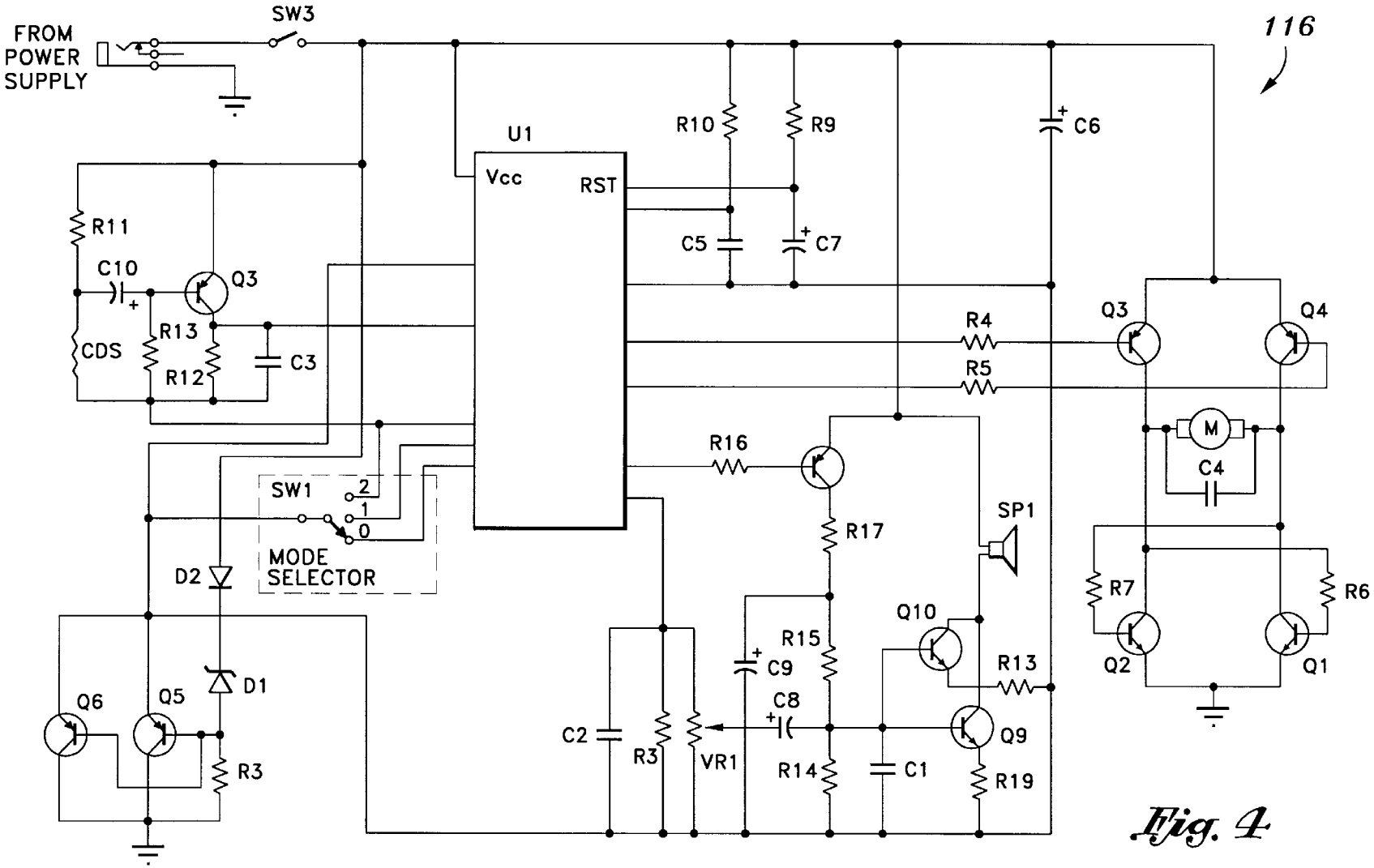
FIG. 4 is a circuit diagram for the motor speed control unit shown in FIG. 3.

Included in the electronic circuitry 110 of the animated toy 10 is a variable motor speed control unit or circuit 116 which is schematically illustrated in FIG. 4. The control unit 116 is in electrical communication with the reversible motor 74, and is operative to selectively increase and decrease the speed of the reversible motor 74 and hence the rate at which the leg members 30 (and thus the waist members 20) are tilted in the first and second directions thereby. Also included in the electronic circuitry 110 is a music unit or circuit which is electrically connected via a pair of wires 118 to a speaker 119 mounted to the inner surface of the front trunk plate 104. The front trunk plate 104 is preferably formed to include a plurality of openings 120 which allow sound waves generated by the speaker 119 to be transmitted to the exterior of the toy body 12. Upon the activation of the animated toy 10, the music unit is operative to produce music signals which, when transmitted to the speaker 119, produce sound waves corresponding to a particular song. It is contemplated that the music unit may also be operative to produce signals which, when transmitted to the speaker 119, result in spoken dialogue being produced thereby. Thus, the activation of the animated toy 10 may result in a particular song alone or in combination with spoken dialogue emanating therefrom. Included in the electronic circuitry 110 is a volume control which allows the volume of music/dialogue transmitted from the speaker 119 to be selectively increased or decreased via a volume control knob 120 which partially protrudes from the foot member 36.

Also included in the electronic circuitry 110 is a sensor or motion detector 122, a portion of which resides within an opening at the front of the foot member 36, thus allowing the sensor 122 to sense motion signals emanating from the front of the animated toy 10. The electronic circuitry 110 also includes a selector switch 123 which allows the animated toy 10 to be operated in three different modes as will be described below. The volume control knob 120 also serves as an on/off switch, with the rotation thereof in one direction beyond a certain threshold (typically corresponding to a minimum volume) deactivating the toy 10 by cutting off the flow of electricity from the external power supply to the electronic circuitry 110.

In the operation of the animated toy 10, the activation of the reversible motor 74 facilitates the rotation of the drive shaft 76 thereof in either a clockwise or counter-clockwise direction. The rotation of the drive shaft 76 facilitates the rotation of the first drive member 86, and hence the second drive member 88 via the transmission belt 92. Due to the meshing of the first gear portion 70 with first gear member 94, the meshing of the second gear portion 96 of the first gear member 94 with the second gear member 98, and the meshing of the third gear portion 102 of the second gear member 98 with the rack portions 80 of the rack members 78, the rotation of the drive shaft 76 is translated by the gear transmission train into the simultaneous rotation of the rack members 78.

More particularly, due to the manner in which the third gear portion 102 of the second gear member 98 is cooperatively engaged to the rack portions 80, the rotation of the third gear portion 102 in a clockwise direction (i.e., the rotation of the second gear member 98 in a clockwise direction) as viewed from the front of the animated toy 10 as shown in FIG. 5 will result in the concurrent rotation of the rack members 78 in counter-clockwise directions. Such counter-clockwise rotation of the rack members 78 causes the spring portions 82 thereof to act against the leg members 30 which results in the same being tilted in unison in the first direction (i.e., to the left) as viewed from the front of the animated toy 10 as shown in FIG. 5. Conversely, the rotation of the second gear member 98 and hence the third gear portion 102 in a counter-clockwise direction as viewed from the front of the animated toy 10 as shown in FIG. 6 results in the concurrent clockwise rotation of the rack members 78. Such clockwise rotation of the rack portions 80 causes the spring portions 82 to act against the leg members 30 which results in the same being tilted in unison in the second direction (i.e., to the right) as viewed from the front of the animated toy 10 as shown in FIG. 6.

As will be recognized, the direction of rotation of the third gear portion 102 of the second gear member 98 is dictated by the direction of rotation of the drive shaft 76 extending from the reversible motor 74. Thus, the operation of the reversible motor 74 so as to reverse the rotation of the drive shaft 76 at prescribed intervals results in the reciprocal movement or tilting of the leg members 30 in the first and second directions. As indicated above, the front and back trunk plates 104, 106 are each attached to the motor mount 64, and are cooperatively engaged to respective ones of the front and rear pairs of leg pins 70, 72. As a result, as is best seen in FIGS. 5–7, the movement or tilting of the leg members 30 in unison in the first direction (to the left) results in the concurrent or simultaneous movement or tilting of the motor mount 64 in the second direction (to the right). Conversely, the tilting of the leg members 30 in unison in the second direction (to the right) results in the simultaneous tilting of the motor mount 64 in the first direction (to the left).

As is further seen in FIGS. 5–7, integrally formed on opposite sides of the motor mount 64 is a pair of internally threaded tubular bosses 124 which receive two of the fasteners (i.e., screws) used to attach the front trunk plate 104 thereto. As the motor mount 64 tilts in the first and second directions, these bosses 124 act against corresponding camming surfaces formed on the waist members 20 as results in the concurrent or simultaneous movement or tilting of the waist members 20 in the same direction as the motor mount 64. In this respect, due to the waist members 20 being pivotally connected to both the leg members 30 and shoulder member 14, the tilting of the motor mount 64 in the second direction (to the right) results in the bosses 124 thereof acting against the waist members 20 in a manner which facilitates the simultaneous tilting of the waist members 20 in the second direction (to the right). Conversely, the tilting of the motor mount 64 in the first direction (to the left) results in the bosses 124 thereof acting against the waist members 20 in a manner facilitating the simultaneous tilting thereof in the second direction (to the left).

As previously explained, the head pin 50 of the head member 44 is extended between the cam levers 68 of the motor mount 64. Due to the head pin 50 being radially offset from the central axis CA of the stem section 46, the movement or tilting of the motor mount 64 in the first direction causes the cam levers 68 to act against the head pin 50 in a manner facilitating the rotation of the stem section 46, and hence the head member 44, in a first direction. Conversely, the tilting of the motor mount in the second direction causes the cam levers 68 to act against the head pin 50 in a manner resulting in the rotation of the head member 44 in a second direction opposite the first direction. Thus, the back and forth movement of the motor mount 64 in the first and second directions results in the alternate rotation of the head member 44 of the toy body 12 in opposite directions.

Similarly, due to the receipt of the arm pins 42 of the arm members 38 into the slots 28 of respective ones of the cam portions 26, the tilting of the waist members in the first and second directions results in the simultaneous rotation of the arm members 38 in opposite directions. For example, as viewed from the front of the animated toy 10 as shown in FIG. 5, the tilting of the waist members 20 in the second direction (to the right) results in the right arm member 38 being rotated upwardly while the left arm member 38 is simultaneously rotated downwardly. Conversely, the tilting of the waist members 20 in the first direction (to the left) as viewed from the front of the animated toy 10 as shown in FIG. 6 results in the left arm member 38 being rotated upwardly while the right arm member 38 is simultaneously rotated downwardly. Thus, the tilting of the leg members 30 in the first and second directions results in the alternate rotation of the arm members 38 in opposite directions.

Thus, as is apparent from the foregoing description, the activation of the reversible motor 74 of the drive unit 62 imparts to the toy body 12 of the animated toy 10 various ranges of movement which create the appearance that the animated toy 10 is dancing. In this respect, the tilting of the waist members 20 and leg members 30 in opposite directions create the appearance that the animated toy 10 is swinging its hips. The simultaneous movement of the arm members 38 upwardly and downwardly in opposite directions and the simultaneous rotation of the head member 44 in opposite directions completes the overall appearance of dancing. Importantly, the electronic circuitry 110 of the animated toy 10 is specifically configured sequence or time the tilting of the leg members 30, and hence all of the movements of the toy body 12, with the song transmitted from the speaker 119. As will be recognized, such timing or sequencing creates an even more life-like appearance since the various motions or movements of the animated toy 10 are not uniform or consistent throughout the entirety of the song, but rather are in time with the music. As will be recognized, the timing of the movements of the toy body 12 to the music is a function of the intervals at which the direction of rotation of the drive shaft 76 of the reversible motor 74 is reversed, with such changes in rotational direction being controlled or regulated by the electronic circuitry 110.

In addition to the electronic circuitry 110 being operative to time or sequence the movements of the toy body 12 with the song being played, the inclusion of the motor speed control unit 116 within the electronic circuitry 110 also allows for the speed or rate of such movements to be selectively increased or decreased. Thus, in the present animated toy 10, the speed or rate at which the leg members 30 and hence the waist members 20 are tilted in the first and second directions can be selectively increased or decreased to impart an even more life-like appearance to the animated toy 10 during the operation thereof. Thus, both the timing and speed of the various movements of the toy body 12 can be coordinated with the song and/or spoken dialogue generated by the music unit and transmitted by the speaker 119.

As also indicated above, the electronic circuitry 110 of the animated toy 10 is operative to allow the same to operated in three different modes. One of these modes is a continuous play mode wherein the animated toy 10 will sing and dance to the recorded song, with this sequence being repeated over and over again until such time as the animated toy 10 is deactivated (i.e., the volume control knob 120 is rotated to the off position). A second mode is an intermittent play mode wherein the animated toy 10 will sing and dance to the recorded song for several minutes, stop for approximately five minutes, with such process thereafter being repeated until the animated toy 10 is deactivated. The third and final mode is a motion activated play mode wherein the animated toy 10 will sing and dance to the recorded song upon the sensor 122 being tripped by motion within a prescribed proximity in front of the corresponding foot member 36.

Advantageously, in the animated toy 10 of the present invention, the stability of the toy body 12 is maintained throughout the full range of tilting movement of the leg members 30 in the first and second directions. Such stability allows for the omission of a base plate to which the foot members 36 are attached, as is required for the motion toy disclosed in the Chou patent as discussed above. In the animated toy 10 of the present invention, such stability is achieved by the rotation of the drive shaft 76 in the clockwise and counter-clockwise directions, and hence the rotation of the third gear portion 102 of the second gear member 98 in the clockwise and counter-clockwise directions, being tightly controlled by the electronic circuitry 110. Such tight control prevents excessive rotation of the rack members 78 in the clockwise and counter-clockwise directions as could otherwise result in the tilting of the leg members 30 to far in either the first and second directions and the animated toy 10 falling over onto one of its sides. Additionally, even if some over rotation of the rack members 78 occurs, such excess rotation does not result in a loss of stability for the toy body 12. As explained above, the rack members 78 are cooperatively engaged to the leg members 30 via the advancement of the spring portions 82 through the slots of respective ones of the drive tab portions 84. Any excess rotational force imparted by the rack members 78 against the leg members 30 is absorbed by the flexion of the spring portions 82 as opposed to such excess rotational force being translated into over tilting of the leg members 30 which could otherwise result in the tipping of the animated toy 10.

In addition to the spring portions 82 effectively absorbing excess rotational force imparted by the rack members 78 against the leg members 30, the animated toy 10 of the present invention is further preferably provided with a pair of flexible, resilient dampening members 126 which are each attached to the motor mount 64. As seen in FIGS. 5 and 6, as the motor mount 64 and waist members 20 concurrently tilt in the first and second directions, the dampening members 126 alternately engage respective ones of the waist members 20, thus effectively absorbing excess rotational force imparted to the waist members 20 by the bosses 124 of the motor mount 64 acting thereagainst. Thus, the combination of the spring portions 82 and dampening members 126 absorbs excess forces within the toy body 12 which effectively maintains the stability of the animated toy 10 during the extreme limits of its range of motion.

Figure 9:
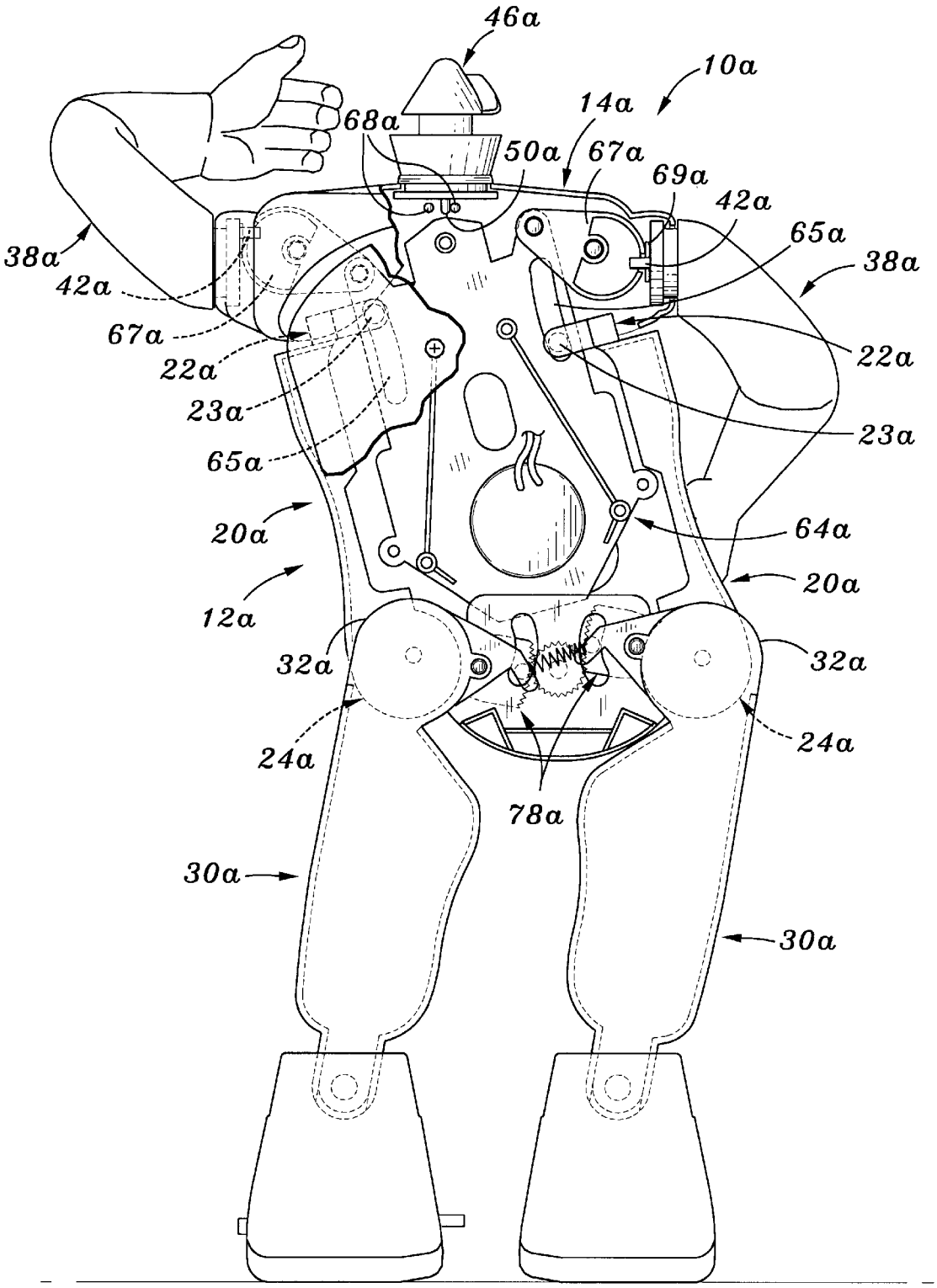
FIG. 9 is a rear elevational, partial cross-sectional view of an alternative embodiment of the present animated toy.

Referring now to FIG. 9, there is depicted an animated toy lOa constructed in accordance with an alternative embodiment of the present invention. The animated toy 10*a* is substantially similar in structure and function to the above-described animated toy 10, with the structural distinctions being described with particularity below.

The alternative embodiment differs from the previously described animated toy 10 only in the configuration of the waist members 20*a* and motor mount 64*a* of the animated toy 10*a*. More particularly, in the animated toy 10*a,* the upper ends 22*a* of the waist members 20*a* are not pivotally connected to the shoulder member 14*a* of the toy body 12*a,* and do not define the previously described cam portions 26. Rather, the upper ends 22*a* are pivotally connected solely to the motor mount 64*a* of the animated toy 10*a*. To facilitate such pivotal connection, each of the waist members 20*a* is formed to include a pin portion 23*a* which defines the upper end 22*a* thereof.

The motor mount 64*a* is similar to the previously described motor mount 64, with the upper end of the motor mount 64*a* being pivotally connected to the shoulder member 14*a* via a fastener such as a pivot pin. The motor mount 64*a* also includes the cam levers 68*a* which protrude from a common side thereof in spaced, generally parallel relation to each other and are adapted to act against the head pin 50*a* protruding from the stem section 46*a*. Formed in the upper portion of the motor mount 64*a* and extending along respective ones of the opposed sides thereof is a pair of arcuately contoured slots 65*a*. In the animated toy 10*a,* the pivotal connection of the waist members 20*a* to the motor mount 64*a* is facilitated by the receipt of the pin portions 23*a* of the waist members 20*a* into respective ones of the slots 65*a*.

The motor mount 64*a* further includes an identically configured pair of cam portions 67*a* which are pivotally connected to the remainder thereof. The cam portion 67*a* are located adjacent the upper end of the motor mount 64*a,* and each include a slot 69*a* formed therein which is adapted to receive the arm pin 42*a* of a respective one of the arm members 38*a* of the animated toy 10*a*.

The animated toy 10*a* operates in a manner similar to that previously described in relation to the animated toy 10. In this respect, the simultaneous rotation of the rack members 78*a* in either the clockwise or counter-clockwise directions results in the leg members 30*a* being tilted in unison in either the first or second directions. The movement or tilting of the leg members 30*a* in unison in the first direction results in the concurrent or simultaneous movement or tilting of the motor mount 64*a* in the second direction, with the tilting of the leg members 30*a* in unison in the second direction resulting the simultaneous tilting of the motor mount 64*a* in the first direction. Due to the receipt of the pin portions 23*a* of the waist members 20*a* into the slots 65*a* of the motor mount 64*a,* as the motor mount 64*a* tilts in the first and second directions, it acts against the waist members 20*a* in a manner facilitating the concurrent or simultaneous movement or tilting thereof in the same direction as the motor mount 64*a*. As the motor mount 64*a* tilts back and forth in the first and second directions, the pin portions 23*a* of the waist members 20*a* travel within respective ones of the slots 65*a,* with pin portions 23*a* typically being disposed at opposite ends of their respective slots 65*a* when the waist members 20*a* reach the maximum limit of tilting movement in the first and second directions. The lower ends 24*a* of the waist members 20*a* are pivotally connected to the upper ends 32*a* of respective ones of the leg members 30*a,* with the upper ends 22*a* of the waist members 20*a* being movably connected solely to the motor mount 64*a* as indicated above.

Due to the receipt of the arm pins 42*a* of the arm members 38*a* into the slots 69*a* of respective ones of the cam portions 67*a* of the motor mount 64*a,* the tilting of the motor mount 64*a* in the first and second directions results in the simultaneous rotation of the arm members 38*a* in opposite directions. As the motor mount 64*a* tilts back and forth in the first and second directions, the cam portions 67*a* alternately pivot upwardly and downwardly in opposite directions relative to the remainder of the motor mount 64*a*. Thus, in the animated toy 10*a,* the rotation of the arm members 38*a* is facilitated solely by the tilting of the motor mount 64*a* in the first and second directions. It is contemplated that the cam portions 67*a*. in addition to being pivotally connected to the remainder of the motor mount 64*a,* may also be pivotally connected to the shoulder member 14*a* of the toy body 12*a* via fasteners such pivot pins. The tilting of the motor mount 64*a* in the first and second directions also facilitates the alternate rotation of the stem section 46*a* in opposite directions in the same manner as described in relation to the animated toy 10 due to the cam levers 68*a* of the motor mount 64*a* acting against the head pin 50*a* of the stem section 46*a*.

These, as well as other features of the present invention, may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. An animated toy, comprising:

a toy body comprising:

at least one shoulder member;

a pair of waist members having upper and lower ends, the upper ends of the waist members being pivotally connected to the shoulder member, with each of the waist members including a cam portion which defines the upper end thereof and has a slot formed therein;

a pair of leg members having upper and lower ends, the lower ends of the waist members being pivotally connected to the upper ends of respective ones of the leg members;

a pair of foot members pivotally connected to the lower ends of respective ones of the leg members; and a pair of arm members rotatably connected to the shoulder member, each of the arm members including an arm pin which protrudes therefrom and is received into the slot of a respective one of the cam portions so as to be alternately movable in different directions thereby;

a drive unit mounted to the toy body and including a reversible motor which is mechanically coupled to the leg members and operative to reciprocally tilt the leg members in first and second directions;

the toy body being configured such that the tilting of the leg members in the first direction causes the waist members to be tilted in the second direction and the tilting of the leg members in the second direction causes the waist members to be tilted in the first direction, with the tilting of the waist members in the first and second directions causing the cam portions to act against the arm pins in a manner facilitating the alternate rotation of the arm members in opposite directions.

2. The animated toy of claim 1 wherein:

the drive unit comprises a motor mount connected to the shoulder member and extending between the waist members;

the reversible motor is attached to the motor mount; and the tilting of the leg members in the first direction causes the motor mount to be tilted in the second direction, with the tilting of the leg members in the second direction causing the motor mount to be tilted in the first direction.

3. The animated toy of claim 2 wherein the toy body further comprises a head member rotatably connected to the shoulder member and mechanically coupled to the motor mount such that the tilting of the motor mount in the first and second directions causes the head member to alternately rotate in different directions.

4. The animated toy of claim 3 wherein:

the motor mount includes a pair of cam levers protruding therefrom in spaced relation to each other; and the head member defines a central axis and includes a head pin protruding therefrom in radially off-set relation to the central axis;

the head pin extending between the cam levers such that the tilting of the motor mount in the first and second directions causes the cam levers to act against the head pin in a manner facilitating the alternate rotation of the head member in opposite directions.

5. The animated toy of claim 2 wherein the toy body further comprises at least one trunk plate attached to the motor mount.

6. The animated toy of claim 5 comprising a front trunk plate attached to the motor mount and a back trunk plate attached to the motor mount.

7. The animated toy of claim 1 further comprising a variable speed control unit disposed within the toy body and in electrical communication with the reversible motor, the control unit being operative to selectively increase and decrease the speed of the reversible motor and hence the rate at which the leg members are tilted in the first and second directions thereby.

8. The animated toy of claim 1 wherein:

the toy body further comprises a pair of rack members rotatably connected to respective ones of the leg members, each of the rack members including a rack portion and a spring portion which is cooperatively engagable to a respective one of the leg members; and the drive unit further comprises a gear train mechanically coupled to the reversible motor and cooperatively engaged to the rack portions of the rack members;

the tilting of the leg members in the first and second directions being limited by the alternate engagement of the spring portions of the rack members to respective ones of the leg members.

9. The animated toy of claim 8 wherein:

the drive unit further comprises a motor mount pivotally connected to the shoulder member and extending between the waist members such that the tilting of the leg members in the first direction causes the motor mount to be tilted in the second direction, and the tilting of the leg members in the second direction causes the motor mount to be tilted in the first direction, the reversible motor being attached to the motor mount; and the toy body further comprises a pair of dampening members attached to the motor mount and alternately engagable to the waist members during the tilting thereof in the first and second directions.

10. The animated toy of claim 1 further comprising:

a variable speed control unit disposed within the toy body and in electrical communication with the reversible motor, the control unit being operative to selectively increase and decrease the speed of the reversible motor and hence the rate at which the leg members are tilted in the first and second directions thereby; and a pair of rack members rotatably connected to respective ones of the leg members, each of the rack members including a rack portion and a spring portion which is cooperatively engagable to a respective one of the leg members such that the tilting of the leg members in the first and second directions is limited by the alternate engagement of the spring portions of the rack members to respective ones of the leg members.

11. An animated toy, comprising:

a toy body comprising:

at least one shoulder member;

a pair of waist members having upper and lower ends, the upper ends of the waist members being pivotally connected to the shoulder member;

a pair of leg members having upper and lower ends, the lower ends of the waist members being pivotally connected to the upper ends of respective ones of the leg members; and a pair of foot members pivotally connected to the lower ends of respective ones of the leg members;

a drive unit mounted to the toy body and including a reversible motor which is mechanically coupled to the leg members and operative to reciprocally tilt the leg members in first and second directions;

a variable speed control unit disposed within the toy body and in electrical communication with the reversible motor, the control unit being operative to selectively increase and decrease the speed of the reversible motor;

a speaker mounted to the toy body; and a music unit disposed within the toy body and in electrical communication with the speaker and the control unit, the music unit being operative to produce music signals;

the toy body being configured such that the tilting of the leg members in the first direction causes the waist members to be tilted in the second direction and the tilting of the leg members in the second direction causes the waist members to be tilted in the first direction, the control unit being operative to increase and decrease the speed of the reversible motor in time with the music signals produced by the music unit and transmitted to the speaker.

12. The animated toy of claim 11 further comprising:

a pair of rack members rotatably connected to respective ones of the leg members, each of the rack members including a rack portion and a spring portion which is cooperatively engageable to a respective one of the leg members such that the tilting of the leg members in the first and second directions is limited by the alternate engagement of the spring portions of the rack members to respective ones of the leg members.

13. An animated toy, comprising:

a toy body comprising:

at least one shoulder member;

a pair of waist members having upper and lower ends, the upper ends of the waist members being pivotally connected to the shoulder member;

a pair of leg members having upper and lower ends, the lower ends of the waist members being pivotally connected to the upper ends of respective ones of the leg members; and a pair of foot members pivotally connected to the lower ends of respective ones of the leg members;

a pair of rack members rotatably connected to respective ones of the leg members, each of the rack members including a rack portion and a spring portion which is cooperatively engageable to a respective one of the leg members;

a drive unit comprising:

a motor mount pivotally connected to the shoulder member and extending between the waist members;

a reversible motor attached to the motor mount and operative to reciprocally tilt the leg members in first and second directions; and a gear train mechanically coupled to the reversible motor and cooperatively engaged to the rack portions of the rack members;

a pair of dampening members attached to the motor mount;

the toy body being configured such that the tilting of the leg members in the first direction causes the waist members and the motor mount to be tilted in the second direction and the tilting of the leg members in the second direction causes the waist members and the motor mount to be tilted in the first direction, with the tilting of the leg members in the first and second directions being limited by the alternate engagement of the spring portions of the rack members to respective ones of the leg members and the dampening members being alternately engageable to the waist members during the tilting thereof in the first and second directions.

14. An animated toy, comprising:

a toy body comprising:

at least one shoulder member;

a pair of waist members;

a pair of leg members pivotally connected to respective ones of the waist members;

a pair of foot members pivotally connected to respective ones of the leg members; and a pair of arm members rotatably connected to the shoulder member, each of the arm members including an arm pin which protrudes therefrom;

a motor mount pivotally connected to the shoulder member and including a pair of pivoting cam portions which each have a slot formed therein, the waist members being pivotally connected to the motor mount, with the arm pin of each of the arm members being received into the slot of a respective one of the cam portions so as to be alternately movable in different directions thereby; and a reversible motor attached to the motor mount, the reversible motor being mechanically coupled to the leg members and operative to reciprocally tilt the leg members in first and second directions;

the animated toy being configured such that the tilting of the leg members in the first direction causes the waist members and the motor mount to be tilted in the second direction and the tilting of the leg members in the second direction causes the waist members and the motor mount to be tilted in the first direction, the tilting of the motor mount in the first and second directions causing the cam portions to act against the arm pins in a manner facilitating the alternate rotation of the arm members in opposite directions.

15. The animated toy of claim 14 wherein the toy body further comprises a head member rotatably connected to the shoulder member and mechanically coupled to the motor mount such that the tilting of the motor mount in the first and second directions causes the head member to alternately rotate in different directions.

16. The animated toy of claim 15 wherein:

the motor mount includes a pair of cam levers protruding therefrom in spaced relation to each other; and the head member defines a central axis and includes a head pin protruding therefrom in radially off-set relation to the central axis;

the head pin extending between the cam levers such that the tilting of the motor mount in the first and second directions causes the cam levers to act against the head pin in a manner facilitating the alternate rotation of the head member in opposite directions.

17. The animated toy of claim 14 wherein the toy body further comprises at least one trunk plate attached to the motor mount.

18. The animated toy of claim 17 comprising a front trunk plate attached to the motor mount and a back trunk plate attached to the motor mount.

19. The animated toy of claim 14 further comprising a variable speed control unit disposed within the toy body and in electrical communication with the reversible motor, the control unit being operative to selectively increase and decrease the speed of the reversible motor and hence the rate at which the leg members are tilted in the first and second directions thereby.

20. The animated toy of claim 14 wherein:

the toy body further comprises a pair of rack members rotatably connected to respective ones of the leg members, each of the rack members including a rack portion and a spring portion which is cooperatively engageable to a respective one of the leg members; and a gear train is mechanically coupled to the reversible motor and cooperatively engaged to the rack portions of the rack member;

the tilting of the leg members in the first and second directions being limited by the alternate engagement of the spring portions of the rack members to respective ones of the leg members.

21. The animated toy of claim 20 wherein the toy body further comprises a pair of dampening members attached to the motor mount and alternately engagable to the waist members during the tilting thereof in the first and second directions.

22. The animated toy of claim 14 further comprising:

a variable speed control unit disposed within the toy body and in electrical communication with the reversible motor, the control unit being operative to selectively increase and decrease the speed of the reversible motor and hence the rate at which the leg members are tilted in the first and second directions thereby; and a pair of rack members rotatably connected to respective ones of the leg members, each of the rack members including a rack portion and a spring portion which is cooperatively engagable to a respective one of the leg members such that the tilting of the leg members in the first and second directions is limited by the alternate engagement of the spring portions of the rack members to respective ones of the leg members.

23. An animated toy, comprising:

a toy body comprising:

at least one shoulder member;

a pair of waist members having upper and lower ends, the upper ends of the waist members being pivotally connected to the shoulder member;

a pair of leg members having upper and lower ends, the lower ends of the waist members being pivotally connected to the upper ends of respective ones of the leg members;

a pair of foot members pivotally connected to the lower ends of respective ones of the leg members;

a pair of arm members rotatably connected to the shoulder member and mechanically coupled to the upper ends of respective ones of the waist members so as to be alternately movable in different directions thereby; and a head member rotatably connected to the shoulder member, the head member defining a central axis and including a head pin protruding therefrom in radially offset relation to the central axis;

a drive unit mechanically coupled to the leg members and including a motor mount which is connected to the shoulder member and a reversible motor which is attached to the motor mount and operative to reciprocally tilt the leg members in first and second directions, the motor mount including a pair of cam levers protruding therefrom in spaced relation to each other;

the toy body being configured such that the tilting of the leg members in the first direction causes the waist members and the motor mount to be tilted in the second direction and the tilting of the leg members in the second direction causes the waist members and the motor mount to be tilted in the first direction, the arm members being mechanically coupled to the waist members such that the tilting of the waist members in the first and second directions causes the arm members to alternately move in different directions, and the head pin extending between the cam levers such that the tilting of the motor mount in the first and second directions causes the cam levers to act against the head pin in a manner facilitating the alternate rotation of the head member in opposite directions.

24. An animated toy, comprising:

a toy body comprising:

at least one shoulder member;

a pair of waist members;

a pair of leg members pivotally connected to respective ones of the waist members;

a pair of foot members pivotally connected to respective ones of the leg members;

a pair of arm members rotatably connected to the shoulder member; and a head member rotatably connected to the shoulder member, the head member defining a central axis and including a head pin protruding therefrom in radially offset relation to the central axis;

a motor mount pivotally connected to the shoulder member and including a pair of cam levers protruding therefrom in spaced relation to each other, the waist members being pivotally connected to the motor mount and the arm members being mechanically coupled to the motor mount so as to be alternately movable in different directions thereby; and a reversible motor attached to the motor mount, the reversible motor being mechanically coupled to the leg members and operative to reciprocally tilt the leg members in first and second directions;

the animated toy being configured such that the tilting of the leg members in the first direction causes the waist members and the motor mount to be tilted in the second direction and the tilting of the leg members in the second direction causes the waist members and the motor mount to be tilted in the first direction, the arm members being mechanically coupled to the motor mount such that the tilting of the motor mount in the first and second directions causes the arm members to alternately move in different directions, and the head pin extending between the cam levers such that the tilting of the motor mount in the first and second directions causes the cam levers to act against the head pin in a manner facilitating the alternate rotation of the head member in opposite directions.

25. An animated toy, comprising:

a toy body comprising:

at least one shoulder member;

a pair of waist members having upper and lower ends, the upper ends of the waist members being pivotally connected to the shoulder member;

a pair of leg members having upper and lower ends, the lower ends of the waist members being pivotally connected to the upper ends of respective ones of the leg members;

a pair of arm members rotatably connected to the shoulder member and mechanically coupled to the upper ends of respective ones of the waist members so as to be alternately movably in different directions thereby; and a pair of rack members rotatably connected to respective ones of the leg members, each of the rack members including a rack portion and a spring portion which is cooperatively engageable to a respective one of the leg members;

a drive unit comprising:

a motor mount pivotally connected to the shoulder member and extending between the waist members;

a reversible motor attached to the motor mount and mechanically coupled to the leg members, the reversible motor being operative to reciprocally tilt the leg members in the first and second directions; and a gear train mechanically coupled to the reversible motor and cooperatively engaged to the rack portions of the rack members;

a pair of dampening members attached to the motor mount;

the toy body being configured such that the tilting of the leg members in the first direction causes the waist members and the motor mount to be tilted in the second direction and the tilting of the leg members in the second direction causes the waist members and the motor mount to be tilted in the first direction, the arm members being mechanically coupled to the waist members such that the tilting of the waist members in the first and second directions causes the arm members to alternately move in different directions, with the tilting of the leg members in the first and second directions being limited by the alternate engagement of the spring portions of the rack members to respective ones of the leg members and the dampening members being alternately engageable to the waist members during the tilting thereof in the first and second directions.

26. An animated toy, comprising:

a toy body comprising:

at least one shoulder member;

a pair of waist members having upper and lower ends, the upper ends of the waist members being pivotally connected to the shoulder member;

a pair of leg members having upper and lower ends, the lower ends of the waist members being pivotally connected to the upper ends of respective ones of the leg members;

a pair of foot members pivotally connected to the lower ends of respective ones of the leg members; and a pair of arm members rotatably connected to the shoulder member and mechanically coupled to the upper ends of respective ones of the waist members so as to be alternately movable in different directions thereby;

a drive unit mounted to the toy body and including a reversible motor which is mechanically coupled to the leg members and operative to reciprocally tilt the leg members in first and second directions;

a variable speed control unit disposed within the toy body and in electrical communication with the reversible motor, the control unit being operative to selectively increase and decrease the speed of the reversible motor and hence the rate at which the leg members are tilted in the first and second directions thereby; and a pair of rack members rotatably connected to respective ones of the leg members, each of the rack members including a spring portion which is cooperatively engageable to a respective one of the leg members;

the toy body being configured such that the tilting of the leg members in the first direction causes the waist members to be tilted in the second direction and the tilting of the leg members in the second direction causes the waist members to be tilted in the first direction, the tilting of the leg members in the first and second directions being limited by the alternate engagement of the spring portions of the rack members to respective ones of the leg members, with the arm members being mechanically coupled to the waist members such that the tilting of the waist members in the first and second directions causes the arm members to alternately move in different directions.

27. An animated toy, comprising:

a toy body comprising:

at least one shoulder member;

a pair of waist members;

a pair of leg members pivotally connected to respective ones of the waist members;

a pair of foot members pivotally connected to respective ones of the leg members;

a pair of arm members rotatably connected to the shoulder member; and a pair of rack members rotatably connected to respective ones of the leg members, each of the rack members including a rack portion and a spring portion which is cooperatively engageable to a respective one of the leg members;

a motor mount pivotally connected to the shoulder member, the waist members being pivotally connected to the motor mount and the arm members being mechanically coupled to the motor mount so as to be alternately movable in different directions thereby;

a reversible motor attached to the motor mount, the reversible motor being mechanically coupled to the leg members and operative to reciprocally tilt the leg members in first and second directions;

a gear train mechanically coupled to the reversible motor and cooperatively engaged to the rack portions of the rack members; and a pair of dampening members attached to the motor mount;

the animated toy being configured such that the tilting of the leg members in the first direction causes the waist members and the motor mount to be tilted in the second direction and the tilting of the leg members in the second direction causes the waist members and the motor mount to be tilted in the first direction, the tilting of the leg members in the first and second directions being limited by the alternate engagement of the spring portions of the rack members to respective ones of the leg members, with the dampening members being alternately engageable to the waist members during the tilting thereof in the first and second directions and the arm members being mechanically coupled to the motor mount such that the tilting of the motor mount in the first and second directions causes the arm members to alternately move in different directions.

* * * * *